US005207714A

United States Patent [19]

Hayashi et al.

[11] Patent Number: 5,207,714

[45] Date of Patent: May 4, 1993

[54] EXHAUSTED GAS RECYCLE DEVICE

[75] Inventors: Minoru Hayashi, Nagoya; Nakai Kiyotaka, Chita; Yoshifumi Yamada, Chiryu, all of Japan

[73] Assignee: Aisin Seiki Kabushiki Kaisha, Kariya, Japan

[21] Appl. No.: 824,981

[22] Filed: Jan. 24, 1992

[30] Foreign Application Priority Data

Jan. 25, 1991 [JP] Japan ..... 3-001907[U]

[51] Int. Cl.[5] ..... F02M 25/07

[52] U.S. Cl. ..... 123/568; 123/590

[58] Field of Search ..... 123/52 M, 52 MC, 568, 123/569, 543, 590

[56] References Cited

U.S. PATENT DOCUMENTS

| | | | |
|---|---|---|---|
| Re. 27,993 | 4/1974 | Walker | 123/568 |
| 1,382,285 | 6/1921 | Harris | 123/568 X |
| 2,354,179 | 7/1944 | Blanc | 123/568 |
| 2,633,837 | 4/1953 | Godfrey | 123/568 |
| 2,757,654 | 8/1956 | White | 123/568 |
| 3,710,770 | 1/1973 | Newkirk et al. | 123/568 X |
| 4,094,285 | 6/1978 | Oyama et al. | 123/568 |
| 4,119,071 | 10/1978 | Hattori | 123/568 |
| 4,741,295 | 5/1988 | Hosoya et al. | 123/568 X |

FOREIGN PATENT DOCUMENTS 62-165463 10/1987 Japan .

*Primary Examiner*—Willis R. Wolfe

*Attorney, Agent, or Firm*—Oblon, Spivak, McClelland, Maier & Neustadt

[57] ABSTRACT

An exhausted gas recycle device which is installed in an intake manifold is comprised of an inlet portion which penetrates into the intake manifold and communicates with an exhaust manifold and at least one hole formed on the inlet portion in the intake manifold.

6 Claims, 4 Drawing Sheets

EXHAUSTED GAS RECYCLE DEVICE

BACKGROUND OF THE INVENTION

FIELD OF THE INVENTION

This invention relates to an exhausted gas recycle device which is connected to a resin intake manifold.

DESCRIPTION OF THE RELATED ART

In general, an exhausted gas recycle device is installed to connect to an intake manifold. As shown in FIG. 7, an exhausted gas recycle device 12 of the prior art (Japanese utility model laid open 1987(62)-165463) is shaped like a pipe and connected into an inlet hole 11*a* opened in a wall of the intake manifold 11 of an automobile engine 14. An insulative tube 13 made of resin is installed in the intake manifold in order that the exhausted gas may hit an inner wall 13*a* thereof.

The exhausted gas recycle device 12 is fixed to the insulative tube 13 by force or by a screw. When the resin from which make the insulative tube 13 is made is a cheap one, for example, 6-nylon, 6,6-nylon or polyethyleneterephthalate, a part of the inner wall 13*a* which is opposite to the exhausted gas recycle device 12 degrades because the heat thereof is very high. In addition, fastening the insulative tube 13 to the inner surface of the intake manifold 11 is difficult and the insulative tube 13 separates from the intake manifold 11 due to expansion and shrinking with heat. Moreover the insulative tube 13 and the parts surrounding may sometimes be broken.

SUMMARY OF THE INVENTION

It is an object of the invention to provide an improved exhausted gas recycle device which obviates the above conventional drawbacks.

It is another object of the invention to provide an improved exhausted gas recycle device in which parts of the resin are not broken by deterioration the case of that an inlet hole is formed on the intake manifold.

In order to attain the foregoing objects, an exhausted gas recycle device which is installed on an intake manifold is comprised of an inlet portion which is penetrated into said intake manifold and communicated to an exhaust manifold and at least one hole formed on said inlet portion in said intake manifold.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DESCRIPTION OF THE PREFERRED EMBODIMENTS

Figure 1:
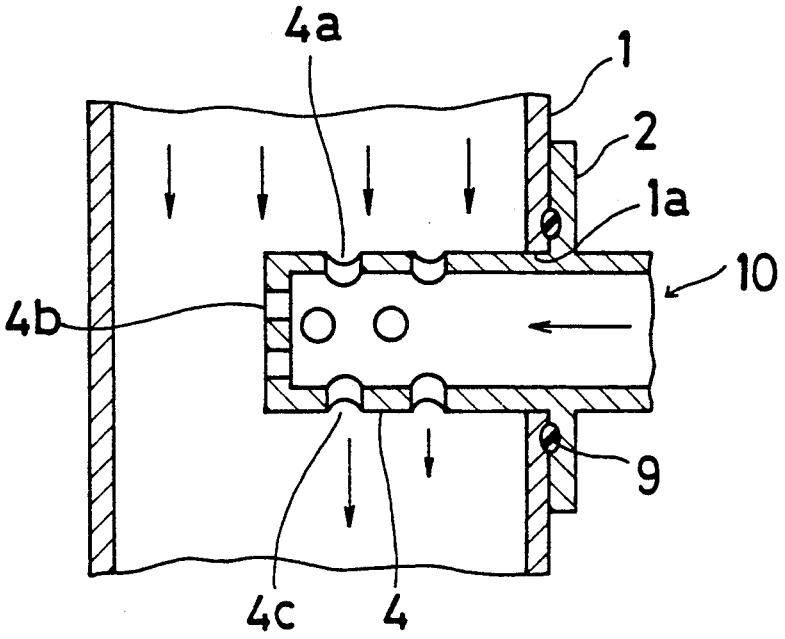
FIG. 1 is a cross sectional view showing an exhausted gas recycle device of the first embodiment according to the present invention.
Figure 2:
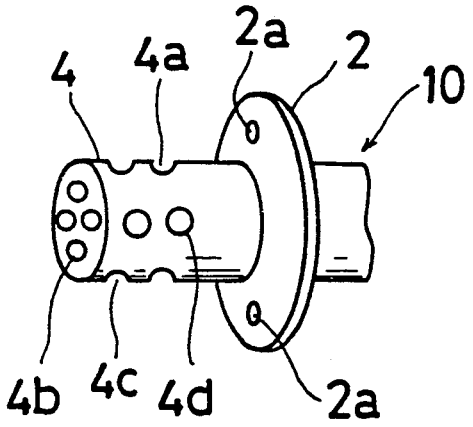
FIG. 2 is a perspective view showing an exhausted gas recycle device of the first embodiment of the present invention.

Referring to FIGS. 1 and 2, there is illustrated an exhausted gas recycle device 10 according to the first embodiment which includes an inlet portion 4 which an exhausted gas flows through. The inlet portion 4 penetrates into an intake manifold 1 and communicates to an exhaust manifold of an engine (not shown) and it has plural holes 4*a*–4*d* which communicate the inner space of the inlet portion 4 with the inner space of the intake manifold 1. A flange 2 is formed surrounding the inlet portion 4. The inlet portion 4 is fixed into an inlet hole 1*a* which is opened on an wall of a resin intake manifold 1 with a ring seal 9 formed around the inlet hole 1*a*. For example, the inlet portion 4 and the intake manifold 1 may be fixed with screws (not shown) into a screw hole 2*a* of the flange 2. Thus the exhausted gas flows out from the holes 4*a*–4*d* to the inner space of the intake manifold 1. The exhausted gas is diffused through the holes 4*a*–4*d* so that it does not directly attack the inner surface of intake manifold 1 opposite to the inlet portion 4. Therefore the resin intake manifold 1 is pretected from deterioration.

Figure 3:
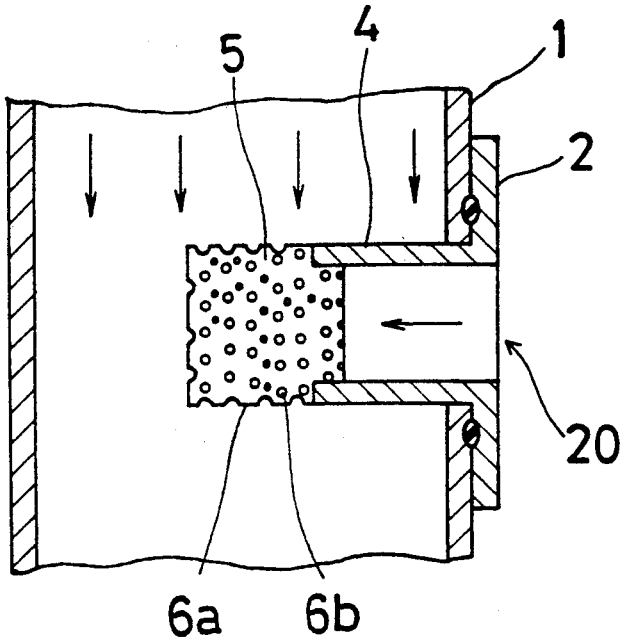
FIG. 3 is a cross sectional view showing an exhausted gas recycle device of the second embodiment according to the present invention.
Figure 4:
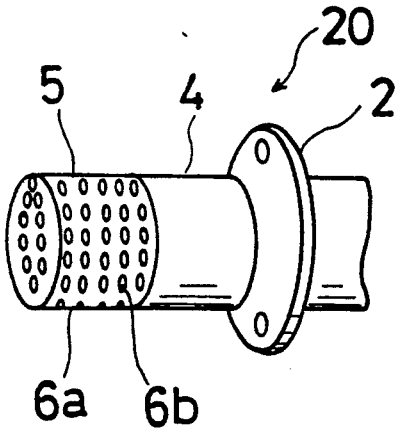
FIG. 4 is a perspective view showing an exhausted gas recycle device of the second embodiment of the present invention.

Referring to FIGS. 3 and 4, there is illustrated an exhausted gas recycle device 20 according to the second embodiment. The exhausted gas recycle device 20 is installed in the intake manifold 1 the same as the first embodiment. In this embodiment, a porous member 5 which is sintered, for example, made of ceramics, is fixed into the end of the inlet portion 4 by force. The porous member 5 can also be installed to the end of the inlet portion 4 by adhesives. The exhausted gas is diffused through the small holes 6*a*, 6*b* of the porous member 5 so that the resin intake manifold 1 is protected from deterioration.

Figure 5:
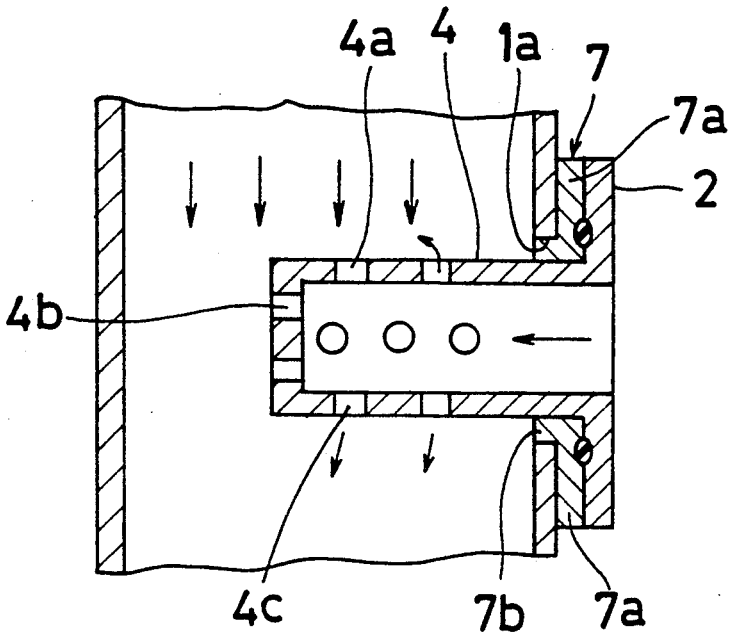
FIG. 5 is a cross sectional view showing an exhausted gas recycle device of the third embodiment according to the present invention.

FIG. 5 shows a third preferred embodiment according to this invention. In this embodiment, the inlet hole 1*a* in the intake manifold 1 is bigger than the diameter of the inlet portion 4 and a heat insulator 7 which is made of phenol resin is installed between the intake manifold 1 and the inlet portion 4. The heat insulator 7 includes a doughnut plate 7*a* and a projection 7*b* which projects from the center hole of the doughnut plate 7*a*. The inlet portion 4 is installed in the intake manifold 1 through the heat insulator 7. The inlet portion 4 has plural holes 4*a*–4*c*. The inlet hole 1*a* of the intake manifold 1 is not deteriorated because the heat insulator 7 prevents the heat of the inlet portion 4 heated by the exhausted gas from being conveyed to the inlet hole 1*a*. The exhausted gas is diffused through the holes 4*a*–4*c* so that the surface opposite to the inlet portion 4 is protected from deterioration as well.

Figure 6:
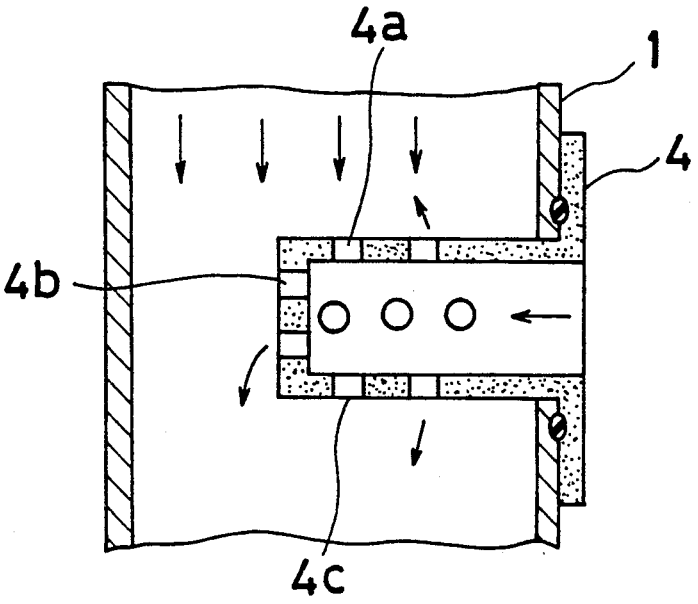
FIG. 6 is a cross sectional view showing an exhausted gas recycle device of the fourth embodiment according to the present invention.
Figure 7:
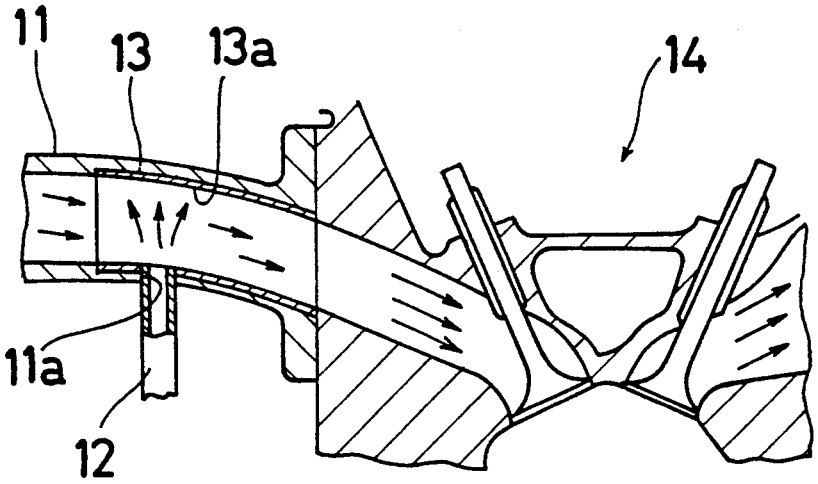
Fig. 7 (PRIOR ART)
FIG. 7 is a cross sectional view showing an exhausted gas recycle device of the prior art.

Referring to FIG. 6 which shows the fourth preferred embodiment of the present invention, the inlet portion 4 is made of a foaming member like azo-di-calbonamid. The foaming member prevents the heat of the exhausted gas from being conveyed to the intake manifold 1. The holes 4*a*–4*c* are opened on the inlet portion 4 to offer the same effect as the first to third embodiments.

For the material of the inlet portion 4, steel, aluminium, other metals, azo-di-calboneamid, phenol resin, unsaturated polyester resin, other thermosetting resins, polyphenylene sulfide (PPS resin), polyether ether ketone (PEEK resin), other thermoplastic resins which are superior in thermal resistance and resistance against deterioration, and ceramics and so on are used.

Obviously numerous modifications and variations of the present invention are possible in light of the above teachings. It is therefore to be understood that within the scope of the appended claims, the invention may be practiced otherwise than as specifically described herein.

What is claimed is:

1. An exhausted gas recycle device which is installed in an intake manifold, comprising:

an inlet portion which penetrates into the intake manifold and communicates to an exhaust manifold, the inlet portion being made of a foaming member; and at least one hole formed in a portion of the inlet portion inside the intake manifold.

2. An exhausted gas recycle device which is installed in an intake manifold, comprising:

an inlet pipe shaped portion which penetrates into the intake manifold and communicates to an exhaust manifold; and a porous member located on the inlet pipe shaped portion inside the intake manifold and extending from an inner surface of the intake manifold, the porous member mixing the exhausted gas and an intake air therein.

3. An exhausted gas recycle device according to claim 2, in which the porous member has at least two holes, the holes being formed on opposite sides of the porous member in the direction of flow of intake air passing through the intake manifold.

4. An exhausted gas recycle device which is installed in an intake manifold, comprising:

an inlet portion which penetrates into the intake manifold and communicates to an exhaust manifold, the inlet portion including a flange which is surrounding the inlet portion, and the inlet portion and the flange being formed as a single body, and the flange being connected to the intake manifold; and at least one hole formed in a portion of the inlet portion inside the intake manifold.

5. An exhausted gas recycle device according to claim 4 further including a heat insulator which is installed between said intake manifold and said inlet portion.

6. An exhausted gas recycle device according to claim 4, in which the at least one hole is made of a porous member.

* * * * *

UNITED STATES PATENT AND TRADEMARK OFFICE

CERTIFICATE OF CORRECTION

PATENT NO. : 5,207,714

DATED : May 4, 1993

INVENTOR(S) : Minoru Hayashi et al.

It is certified that error appears in the above-identified patent and that said Letters Patent is hereby corrected as shown below:

On the title page, Item [75],

The second inventor's name is incorrect, should read:

--Kiyotaka Nakai--

Signed and Sealed this

Fourth Day of January, 1994

*Attest:*

*Attesting Officer*

BRUCE LEHMAN

*Commissioner of Patents and Trademarks*